United States Patent [19]

Mori

[11] 4,091,444

[45] May 23, 1978

[54] GLOBE-MOUNTING APPARATUS FOR EXPLOSION-PROOF LIGHTING DEVICES

[75] Inventor: Shinjiro Mori, Tokyo, Japan

[73] Assignee: Mori Denki Manufacturing Co., Ltd., Tokyo, Japan

[21] Appl. No.: 719,388

[22] Filed: Aug. 31, 1976

[30] Foreign Application Priority Data

Mar. 26, 1976 Japan ..... 51-33980

[51] Int. Cl.[2] ..... F21V 17/00

[52] U.S. Cl. ..... 362/374; 362/267; 362/164

[58] Field of Search ..... 240/11.2 E, 11.3, 129, 240/134, 135, 147; 109/61, 74, 75; 285/396; 362/164, 21, 22, 375, 374, 267

[56] References Cited

U.S. PATENT DOCUMENTS

| | | | |
|---|---|---|---|
| 261,191 | 7/1882 | Walker | 285/396 |
| 1,076,495 | 10/1913 | Gottschalk et al. | 240/113 |
| 2,259,307 | 10/1941 | Herbold | 240/147 |
| 2,786,936 | 3/1957 | Appleton | 240/11.2 E |

FOREIGN PATENT DOCUMENTS

| | | | |
|---|---|---|---|
| 891,615 | 3/1944 | France | 240/11.3 |
| 311,713 | 4/1919 | Germany | 240/11.3 |
| 402,500 | 3/1943 | Italy | 240/11.3 |

*Primary Examiner*—Fred L. Braun
*Assistant Examiner*—Peter S. Wong
*Attorney, Agent, or Firm*—Wenderoth, Lind & Ponack

[57] ABSTRACT

A globe-mounting apparatus for explosion-proof lighting devices which provides an easier globe-mounting and dismounting operation, and which is furnished with a hinge which joins the lighting body and the globe members. Around the periphery of the opening of the lighting body is formed a circular body facing inside, to which is alternately provided a cut and a projection with a fastening bolt screwed to it. Clamps, which are shorter than the cuts furnished at the opening of the lighting body, are provided around the periphery of the globe holder which holds the globe.

5 Claims, 9 Drawing Figures

GLOBE-MOUNTING APPARATUS FOR EXPLOSION-PROOF LIGHTING DEVICES

BACKGROUND OF THE INVENTION

1. Field of the Invention

This invention relates to a globe-mounting apparatus for explosion-proof lighting devices.

Since the above-mentioned explosion-proof lighting devices are employed at places such as oil refineries where there exists a constant danger of explosion, the inside of a lighting body is structured airtight, and the body and the globe members are built very thick and strong so that it will not discharge electricity outside of the lighting body, even if the electric bulb inside it is broken. Moreover, a packing is mounted on the plane where the lighting body and the flange part of the globe meet each other, and the two parts are fixed to each other by bolts. Because of this, an electric bulb cannot be replaced by another unless all of the above bolts are drawn out. Usually about 6–8 of these fixing bolts are employed, and the replacement of electric bulbs located at the ceilings or pillars is a highly difficult operation, especially since the weight of explosion-proof lighting devices is very heavy, the globe part alone weighing more than 10 kg. Accordingly, if there is no connecting structure between the lighting body and the globe members other than the above fastening bolts, there is always a danger that the globe will drop when the bolts become loose.

2. Brief Description of the Prior Art

In conventional explosion-proof lighting devices, the globe members and the lighting body are connected by a hinge, but there is always a possibility that the globe members will drop when the fastening bolts are loosened, which means that the whole weight of the globe is suddenly on the hinge alone, causing it to be damaged. Thus, when the bolts are to be loosened, an extra person is needed to support the globe other than the one who loosens the bolts. In case there is only one person to do the whole replacing operation, he has to support the globe members with one hand, while loosening the bolts with another. Accordingly, it is required of him to support the weight of more than 10 kg. with one hand until he finishes drawing out all the bolts. This, naturally, is a highly dangerous operation which cannot be easily accomplished.

In view of the fact that the explosion-proof lighting devices are usually mounted in high places intricated with pipes, angles, etc., and because globe members are in general very weighty, it is necessary to employ a number of workers to safely perform the replacement of electric bulbs.

SUMMARY OF THE INVENTION

The present invention, thus, concerns a new lighting body and globe members-mounting apparatus, whose primary object is to provide a mounting device which makes it possible for just one worker to safely handle the mounting and dismounting operation of globe members.

It is another object of the present invention to provide a mounting apparatus which realizes an easier mounting and dismounting operation of globe members by slightly loosening the bolts which fasten the lighting body and globe members. The invention therefore makes it possible to replace an electric bulb in a much shorter time.

It is another object of the present invention to provide a mounting device wherein the globe members will not drop when the bolts which fasten the globe holder are loosened, making for a much safer mounting operation.

DESCRIPTION OF THE PREFERRED EMBODIMENTS

Figure 1:
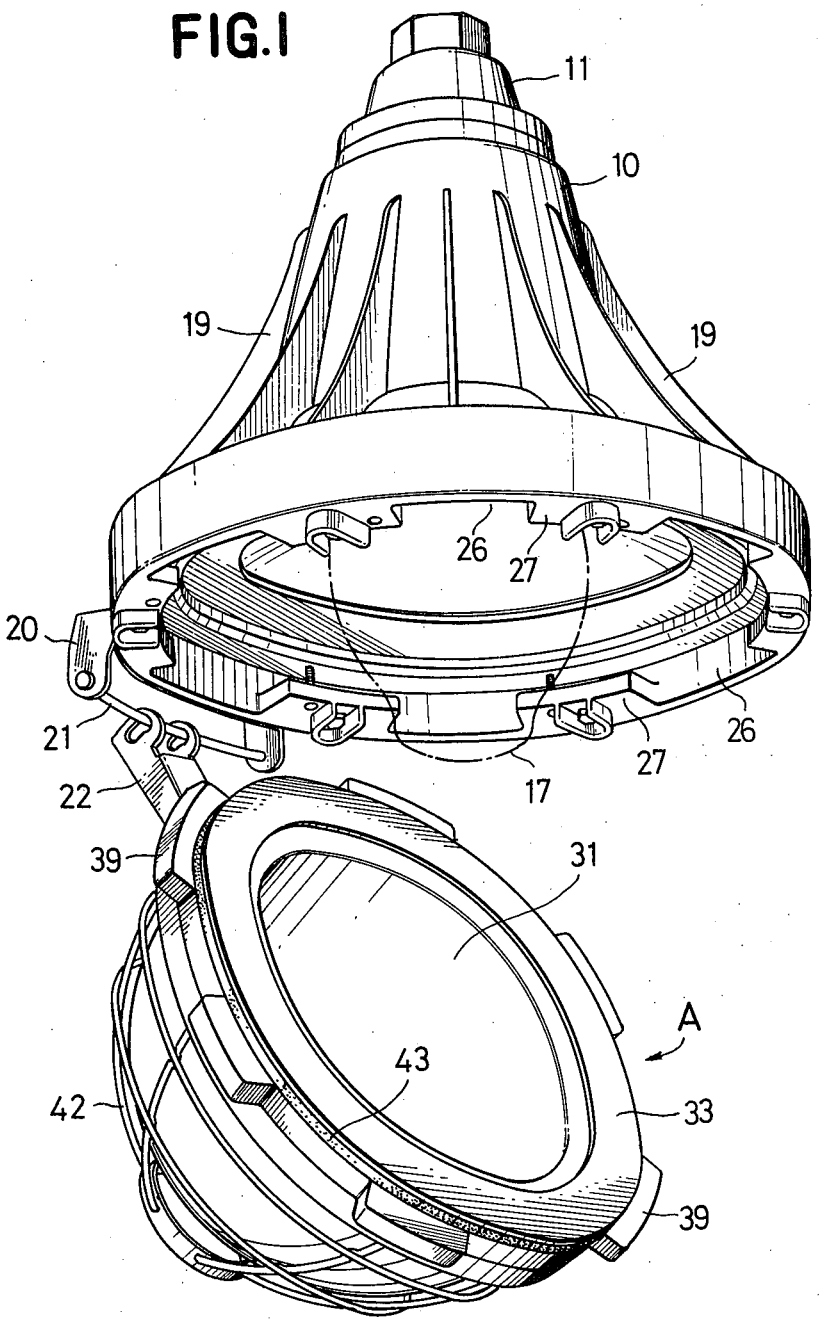
FIG. 1 is a perspective view of the globe members detached from the lighting body of an assembled explosion-proof lighting device.

The details of the present invention will be explained below according to the exemplary embodiment of the invention as disclosed in the drawings.

Figure 2:
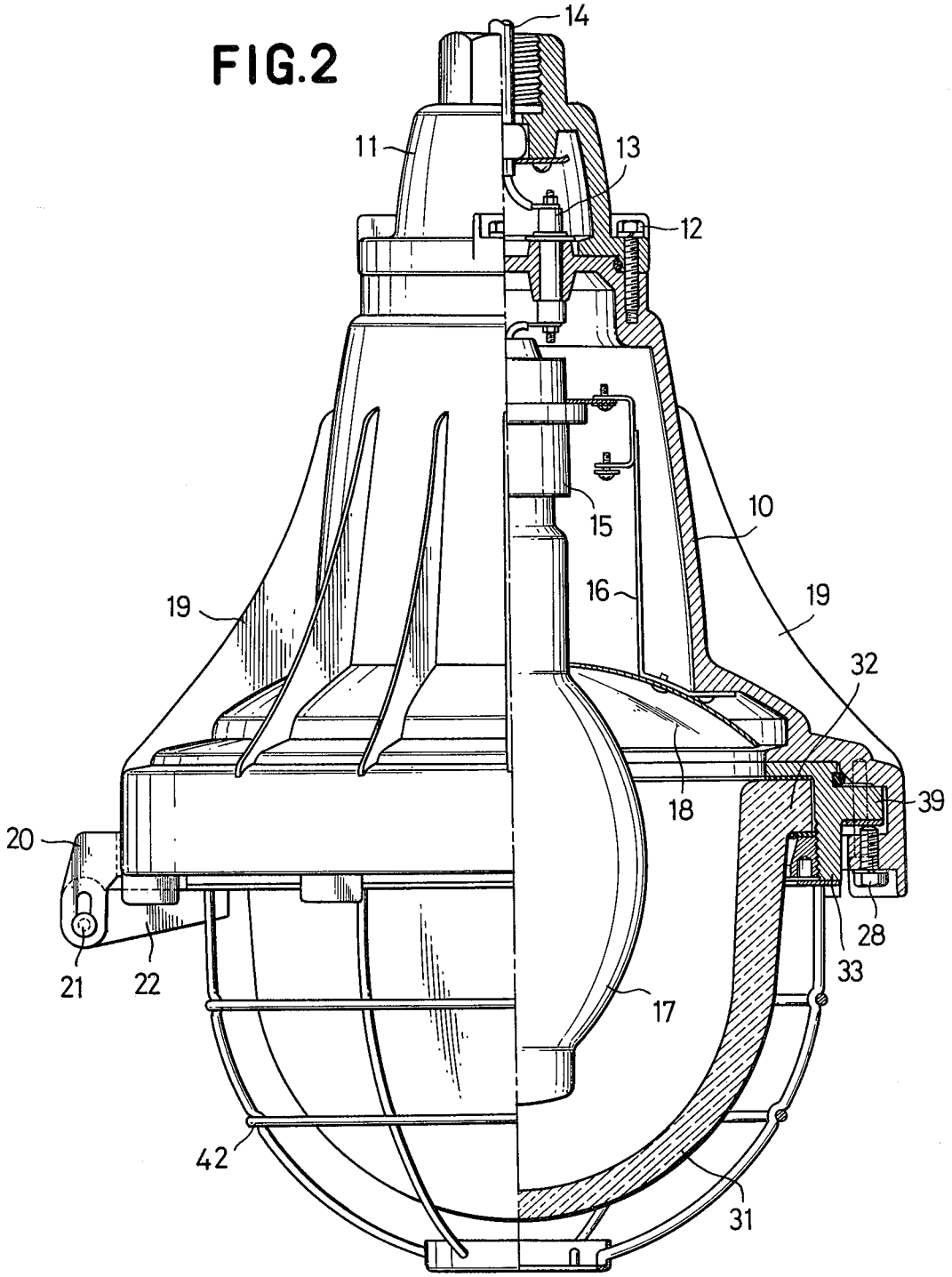
FIG. 2 is a side view of an explosion-proof lighting device, half in a vertical section.

Referring to FIGS. 1 and 2 (particularly to FIG. 2), reference numeral 10 represents a lighting body, one of whose ends is open-ended in a circular form, and to whose other end is fixed socket cover 11 by bolt 12 (shown in detail in FIG. 2).

At the bottom of the latter end is mounted insulator 13 which carries a copper rod inside, in a manner such that it penetrates through the bottom wall. One end of wire 14 guided into above socket cover 11 is connected to one end of the copper rod in the insulator 13 and its other end, which protrudes into the lighting body, is connected to the wire of socket 15 mounted in the body. To the top of socket cover 11 is grooved a female screw (FIG. 2) which, in turn, is connected to a pipe not shown in the figures whose edge is mounted to the ceiling or pillar.

Socket 15 is mounted at the center of the lighting body 10 by three socket fixing clamps 16, fixed at the inner wall of the body, and mercury-vapor lamp 17 is mounted to the socket. Reference numeral 18 indicates a reflecting plate mounted close to the opening of the lighting body, and it is supported by above-mentioned socket fixing clamps 16. Reference numeral 19 indicates a plurality of radiating ribs formed at the peripheral wall of the lighting body 10 in the direction of the body's axis.

Since the whole lighting body of the explosion-proof lighting device is structured so that it is air-tight, it is heated by the heat generated from the electric bulb inside it, and the temperature around the bulb increases. This shortens the durability of the bulb. On the other hand, when many radiating ribs 19 are provided at the outer wall of the lighting body, this air-cooling operation controls the temperature increase and helps to prolong the durability of the electric bulb.

Reference numeral 20 indicates a hinge provided at the side wall of the lighting body 10 and hinge pin 21, which is bent parallel to the radius of curvature of the peripheral edge of the lighting body, is mounted to it. The globe members and the lighting body are linked to each other by mounting the hinge 22 provided at globe member A to the above hinge pin 21. This hinge pin 21 of the hinge 20 of the lighting body 10 has a length which allows it to turn at least 30 degrees, perpendicularly intersecting the direction of the axis of the globe member A.

Referring now to FIGS. 3–7, the details of the part where the lighting body joins the globe members will be described. At the opening of the lighting body is formed a continuous flat surface 23 all along its periphery, and a circular groove 24 is formed on the outside of this flat surface towards the inside of the lighting body. Reference numeral 25 indicates a slanted surface formed between the flat surface 23 and the groove 24, and it serves as the glove-supporting wall which will be explained later. The circular surface formed along the edge of opening of the lighting body is divided into 12 equal parts by the cut of every 30 degrees. Thus, cuts 26 and projections 27 are formed alternately. Fastening bolts 28 which are screwed in from the opening of the lighting body, parallel to the body's axis direction, have such a length that their edges slightly protrude into groove 24. These bolts are fitted into each of above projections 27. Protection covers 29 which protect the projecting parts at the bolt heads are provided in a body with the above projections. Also, screws 30 which are adjacent and parallel to one side of above-mentioned fastening bolts 28 are screwed from projections through groove 24 into the wall opposite the projections.

Since the above protection covers 29 are taller than the heads of the fastening bolts, the loosening of the bolts by some outer shock after they are fully fastened and fixed can be prevented. Also, when the clamps of globe member A, which will be explained later, meet the above screws 30 by rotating the globe members after inserting them through the cuts, they fall in place with projections 27, resulting in fixation of the fastening bolts.

Figure 3:
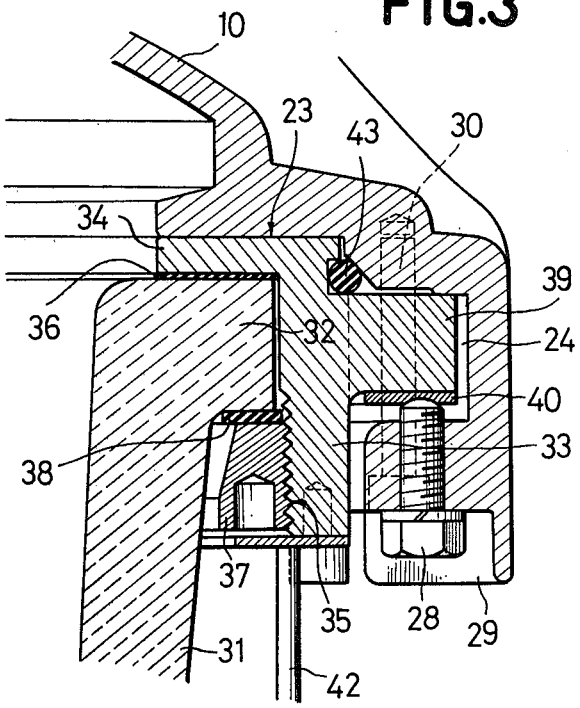
FIG. 3 is a cross-sectional view which shows the detailed view of the part where the opening of the lighting body and the globe holder join each other.
Figure 6:
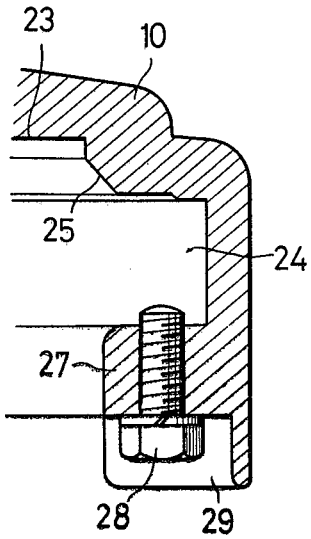
FIG. 6 is a cross-sectional view cut by line 6—6 of FIG. 5.
Figure 7:
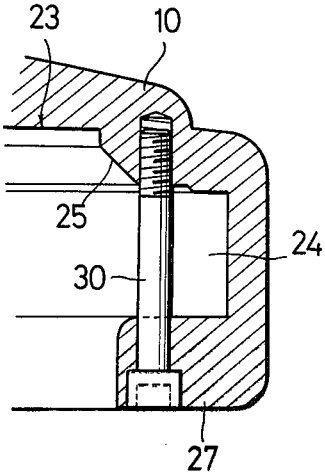
FIG. 7 is a cross-sectional view cut by line 7—7 of FIG. 5.
Figure 4:
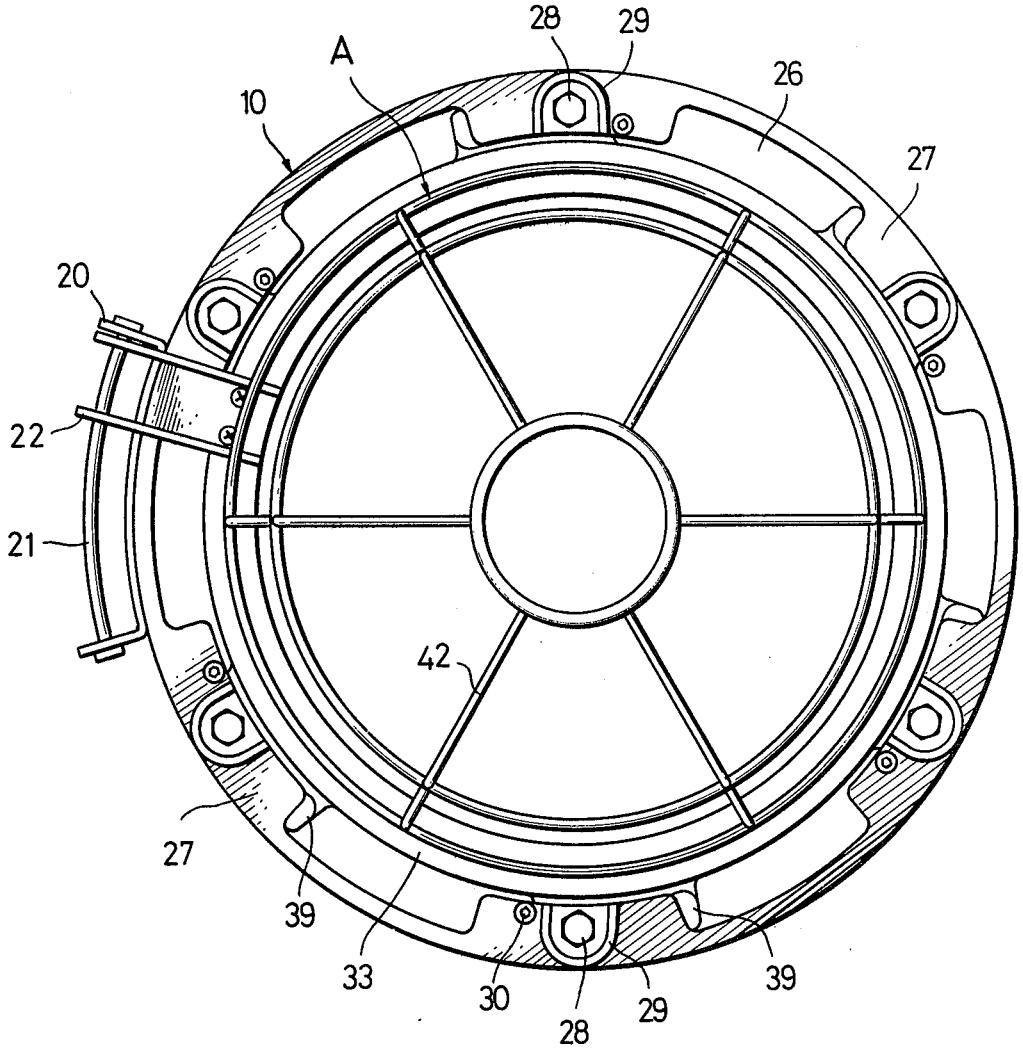
FIG. 4 is a bottom view of the whole lighting body as it is assembled viewed from the globe member side.
Figure 5:
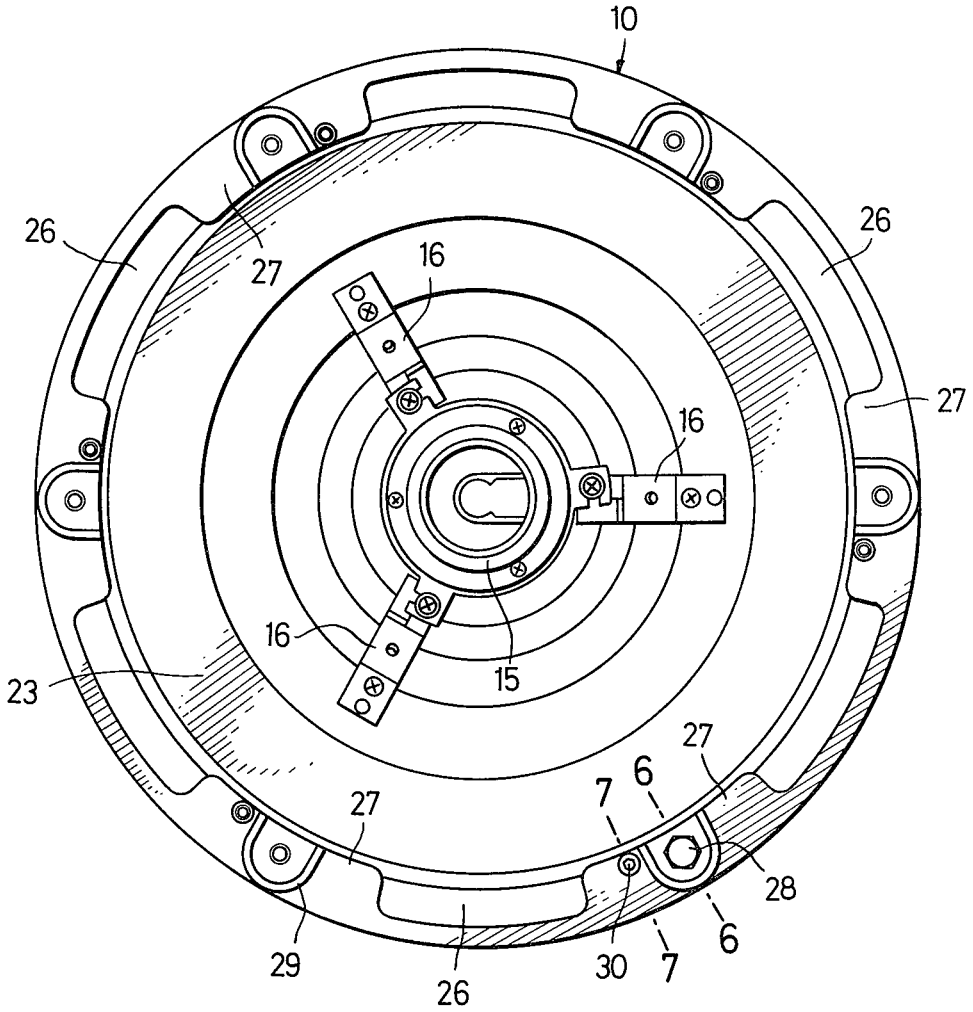
FIG. 5 is a bottom view of the lighting body.
Figure 8:
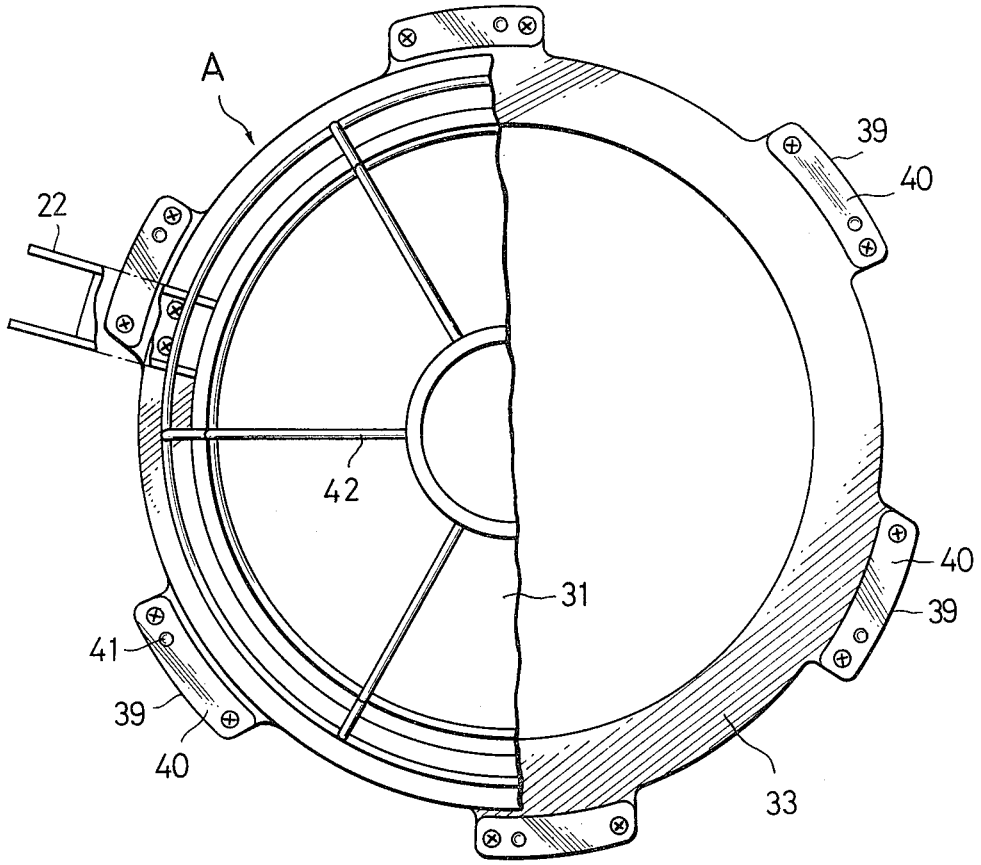
FIG. 8 is a bottom view of the globe members, half of which is omitted.
Figure 9:
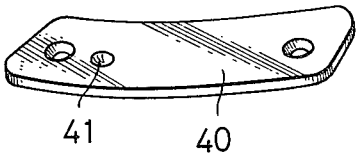
FIG. 9 is a perspective view of the protecting place to be attached to the clamp of the globe holder.

Referring now particularly to FIGS. 3, 8 and 9, the details of the globe members will be described. Globe 31 is made of a hard plastic material, shaped like a bowl. At the outer edge of its opening is formed a flange 32. Reference numeral 33 indicates a circular globe holder inside of which, in turn, is formed a circular body by providing a stage. At the opposite side of the above circular body is grooved a female screw 35. In order to fix the above glove 31 and globe holder 33, the flange 32 of the globe is inserted from the female screw side of globe holder 33, and packing 36 is provided between circular body 34 and the edge of the globe. Finally, globe-supporting ring 37 is screwed into the female screw 35 through packing 38.

Reference numeral 39 indicates clamps of the same number as that of cuts 26 formed outside of globe holder 33 at the opening of the lighting body. The length of the clamps measure shorter than the cuts. Since these clamps are to be received in the groove 24 of the above opening, their protruding width and thickness have to be smaller than the groove. Also, it is necessary to paste a protecting plate 40, of such a material as stainless steel onto the plane which receives the bolts, since clamps 39 are fastened by them after being received within the groove 24. Reference numeral 41 indicates a guide depression formed at the plates 40, which are mounted to the edge of fastening bolt 28.

Reference numeral 42 is a basket-shaped guard which covers the outside of globe 31 and is fixed at globe holder 33. Reference numeral 43 indicates a packing provided halfway between circular body 34 of the globe holder and the clamp 39. Thus, when globe member A is provided at the opening of the lighting body it shows a packing effect, joining with the slanted surface. Also, among the hinges mentioned earlier, the parts to be mounted on the globe member side are fixed at the globe holder 33.

Globe member A connected to the lighting body 10 by a hinge comes in contact with the opening of the lighting body. The clamps 39 of the globe holder 33 are inserted from cuts 26 formed at the opening and are pushed in until the circular body 34 of the globe holder meets the flat surface 23 of the lighting body. When globe member A is turned clockwise viewed from its bottom, each of the clamps meets screw 30 provided in groove 24, and the member A comes to a halt. This results in fastening bolts 28 provided at every projection 27. Thus, fixation of the globe members is completed by the packing effect of packing 43 provided between the globe holder and the lighting body.

When the clamps 39 of the globe holder are fixed by fastening bolts 28 they meet the bottom of the groove, and the circular body 34 of the globe holder meets the flat surface 23 of the opening of the lighting body. Since it is not necessary to screw the above fastening bolts into the clamps, the globe members fixing operation can be accomplished by slightly turning the fastening bolts.

The same effect is observed in the globe members removing operation at the time of electric bulb replacement which requires the removal of the members. Thus, when the globe members are turned counterclockwise after loosening the bolts a little, clamps 39 coincide with the cuts 26 adjacent to projections 27. This causes the whole body of the globe holder to descend with the hinge pin at its center and to be completely freed as shown in FIG. 1.

When the above fastening bolts 28 are loosened, the packing effect of the lighting body and the globe holder no longer works. However, as long as each clamp 39 is located on the projections 27, the globe holder will never drop. Therefore, workers can dismount the globe members by turning them after all the bolts are loosened, and this assures a very safe mounting and dismounting operation.

Also, since the protecting plates 40, made of a material such as stainless steel, are provided where fastening bolts 28 and the clamps 39 meet each other, even repeated fastenings would not change the shape of the clamps.

Having described the present invention which relates to a mounting apparatus that provides a very simple and safe globe members mounting and dismounting operation, it is to be understood that the invention is not limited to the specific embodiments thereof, except as defined in the appended claims.

What is claimed is:

1. A globe mounting apparatus for explosion-proof devices comprising a lighting body which holds an electric light inside, a globe member and a hinge which joins the lighting body and the globe member, said lighting body containing, at the periphery of the opening thereof, a circular flat body containing a circular groove formed on the outside of the flat surface and towards the inside of the lighting body, said circular body being provided with cuts and projections at the periphery thereof, said projections having bolts fastened to the surface thereof which protrude slightly into said circular grooves, said globe member made up essentially of a globe holder and a globe, said globe holder containing, at the periphery thereof, a circular flat body provided with clamps located below the circular flat body in a number corresponding with the number of cuts provided at the opening of the lighting body and being shorter than said cuts, said globe holder containing packing underneath said circular flat body and wherein the globe member is secured to the lighting body by inserting the clamps on the globe holder into the cuts in the opening of the lighting body and twisting it clockwise so that the clamps fit into the grooves located on the upper part of said projections and the bolts on said projections are tightened from the underside to hold the clamps securely in the said grooves on the lighting body, whereby the circular flat body located on the lighting body is held firmly against the circular flat body located on the globe member to form a substantially airtight seal between the globe member and lighting body.

2. A globe-mounting apparatus for explosion-proof lighting devices as claimed in claim 1, provided with a screw which extends itself to the wall of the lighting body, said screw being adjacent and parallel to one side of the fastening bolt, located on the projections for the purpose of acting as a stop for the clamps to enable one to ascertain when the globe member is properly secured to the lighting body.

3. A globe-mounting apparatus for explosion-proof lighting devices as claimed in claim 1, wherein a hard metallic protecting plate is pasted on the surface of the clamps of the globe members where it comes in contact with the fastening bolt.

4. A globe-mounting apparatus for explosion-proof lighting devices as claimed in claim 1, wherein said fastening bolts are formed in a body with the projections at the opening of the lighting body and outside of the protruding heads of said bolts is covered with protection covers.

5. A globe-mounting apparatus for explosion-proof lighting devices as claimed in claim 1, provided with radiation ribs at the outer wall of the lighting body.

* * * * *